US005606304A

United States Patent [19]

Wan

[11] Patent Number: 5,606,304

[45] Date of Patent: Feb. 25, 1997

[54] STRUCTURE OF MAGNET TYPE SOUNDER OF AN ELECTRONIC ACOUSTIC ALARM

[76] Inventor: Ki J. Wan, 4 Fl., No. 13, Alley 1, Lane 212, Sec. 6, Chung Hsiao E. Rd., Taipei, Taiwan

[21] Appl. No.: 572,448

[22] Filed: Dec. 14, 1995

[51] Int. Cl.[6] ..... G08B 3/00

[52] U.S. Cl. ..... 340/384.1; 340/384.7; 340/69.2; 340/391.1; 381/192

[58] Field of Search ..... 340/384.1, 391.1, 340/691, 692, 384.7; 381/192, 188, 205; 181/143, 199

[56] References Cited

U.S. PATENT DOCUMENTS

| | | | |
|---|---|---|---|
| 4,183,017 | 1/1980 | Sims | 340/384.7 |
| 4,443,667 | 4/1984 | Hunt | 381/159 |
| 4,973,941 | 11/1990 | Davis et al. | 340/384.7 |
| 5,287,084 | 2/1994 | Sone | 340/391.1 |
| 5,528,697 | 6/1996 | Saito | 381/192 |

*Primary Examiner*—Jeffery Hofsass
*Assistant Examiner*—Daniel J. Wu
*Attorney, Agent, or Firm*—Pro-Techtor International

[57] ABSTRACT

An improved structure of magnet type sounder of an electronic acoustic alarm mounted on the engine of a car, wherein primarily, a sound emitting circuit board is placed on an acoustic pipe of a supporting plate, and a magnet is held in a housing formed by an encircling plate beneath the supporting plate, and a sound transmitting case is formed as a flare on the bottom portion thereof which is convex in the inward direction to form a spherical dome surface of which an acoustic pipe column is telescopically placed over the acoustic pipe of the supporting plate, this assembly is then placed in a main case body, and further an acoustic resonant lid covers a through hole of the acoustic pipe column of the sound transmitting case, so that an object of volume reducing can be achieved,

1 Claim, 4 Drawing Sheets

STRUCTURE OF MAGNET TYPE SOUNDER OF AN ELECTRONIC ACOUSTIC ALARM

BACKGROUND OF THE INVENTION

1. Field of the Invention

The present invention relates to an improved structure of magnet type sounder of an electronic acoustic alarm mounted on the engine of a car, wherein primarily, a sound emitting circuit board is placed on an acoustic pipe of a supporting plate, and a magnet is held in a housing formed by an encircling plate beneath the supporting plate, and a sound transmitting case is formed as a flare on the bottom portion thereof which is convex in the inward direction to form a spherical dome surface of which an acoustic pipe column is telescopically placed over the acoustic pipe of the supporting plate, this assembly is then placed in a main case body, and further an acoustic resonant lid covers a through hole of the acoustic pipe column of the sound transmitting case, so that an object of volume reducing can be achieved.

2. Description of the Prior Art

A conventional magnet type sounder of an electronic acoustic alarm (referring to FIG. 4) is comprised mainly of the members including a case body A, a sound emitting circuit board B, a magnet C, a sound transmitting seat D and an acoustic resonant lid E etc.. Wherein the sound emitting circuit board B is mounted behind the magnet C, this assembled members are mounted on the sound transmitting seat D provided with a sound transmitting pipe D1, all these are then together placed in the case body A, and the acoustic resonant lid E covers the opening of the sound transmitting pipe D1 of the sound transmitting seat D to induce acoustic resonance for enlarging volume of sound. However, the sound emitting circuit board B therein is mounted behind the magnet C, room is retained solely for mounting of the sound emitting circuit board B, and further, the sound transmitting seat D also needs room, therefore, volume of the case body A can not just be reduced any more. In these days when cars are gradually minimized as well as getting more delicate, room for an engine is relatively narrow and crowded, yet a conventional magnet type sounder of an electronic acoustic alarm has quite a large volume, this makes difficulty and time consuming of assembling or even unability for assembling, in this view, to minimize a magnet type sounder of an electronic acoustic alarm without influencing its volume of sound is a significant subject of studying and development nowadays.

SUMMARY OF THE INVENTION

In order to eliminate the defects resided in the conventional magnet type sounder of an electronic acoustic alarm as stated above, and to achieve the object of minimizing, the inventor of the present invention, as the first person, provides "an improved structure of magnet type sounder of an electronic acoustic alarm" based on his practical experience for years, wherein, the deficient design on the conventional magnet type sounder of an electronic acoustic alarm mounting a sound emitting circuit board behind the magnet to make unability of reducing volume of the case body is discarded and is substituted with the measures of mounting the sound emitting circuit board on an acoustic pipe of a supporting plate and placing the magnet in the supporting plate, further, the assembled members are placed in a case body, and a sound transmitting case having a flared acoustic pipe column is placed on the supporting plate to render the opening of the acoustic pipe column to align with the acoustic pipe, and an acoustic resonant lid covers a through hole of the acoustic pipe column, so that an object of volume reducing can be achieved.

The present invention will be apparent in its practical structure and characteristics of technique after reading the detailed description of the preferred embodiment thereof in reference to the accompanying drawings.

DETAILED DESCRIPTION OF THE PREFERRED EMBODIMENT

Figure 1:
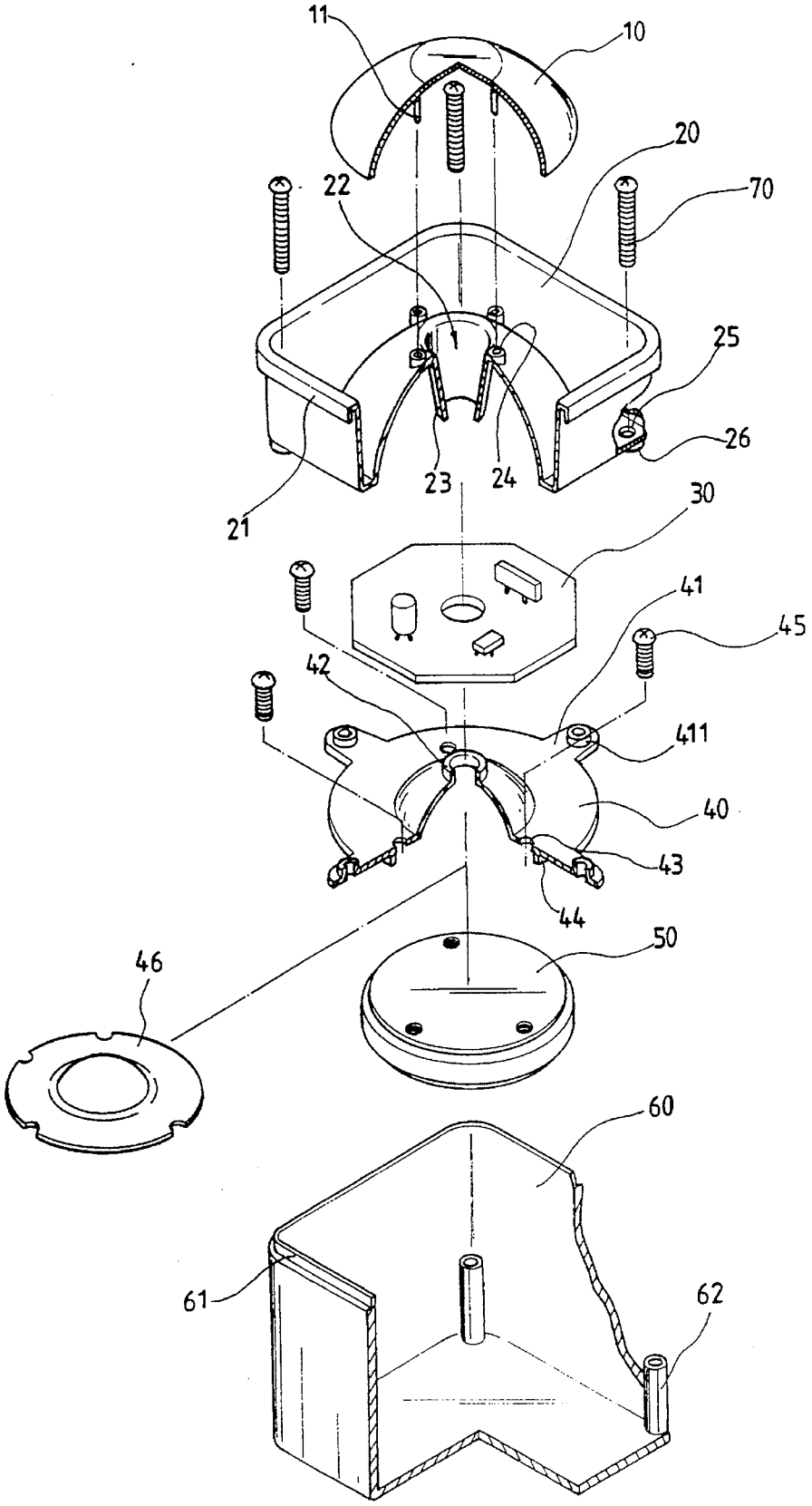
FIG. 1 is a perspective exploded view of the present invention.

As shown in FIG. 1, the present invention is comprised mainly of an acoustic resonant lid 10, a sound transmitting case 20, a sound emitting circuit board 30, a supporting plate 40, a magnet 50, a case body 60 etc., wherein the acoustic resonant lid 10 is in the form of a dome with four fixing rods 11 provided there on; while the sound transmitting case 20 is in the form of a rectangular case, a down bending edge 21 is provided on the periphery of the sound transmitting case 20, yet a spherical dome surface protrudes at the center of the sound transmitting case 20, a through hole 22 extending down to form a flared acoustic pipe column 23 is provided at the center of the spherical dome surface, four fixing holes 24 are provided on the spherical dome surface for fixing the acoustic resonant lid 10, and more, a positioning sleeve 26 each with a through hole 25 is provided at each of the four corners on the bottom of the sound transmitting case 20; the supporting plate 40 is in the form of a round plate, at the locations on the round plate corresponding to those positions of the positioning sleeves 26 of the sound transmitting case 20 there are provided with protruding plates 41 each having a locating column 411, the supporting plate 40 has at the center thereof another spherical dome surface having an acoustic pipe 42, three screw holes 43 are provided on the periphery of the spherical dome surface, an encircling plate 44 is provided beneath the supporting plate 40 to hold therein a sound-film 46 and a magnet 50, then a plurality of screws 45 are screwed down in the screw holes 43 on the supporting plate 40 for receiving the sound-film 46 and the magnet 50 beneath the supporting plate 40; the main case body 60 is in the form of a rectangular case, it has an inserting plate portion 61 for inserting in the down bending edge 21 of the sound transmitting case 20, four fixing columns 62 are provided at the four corners of the main case body 60.

Figure 2:
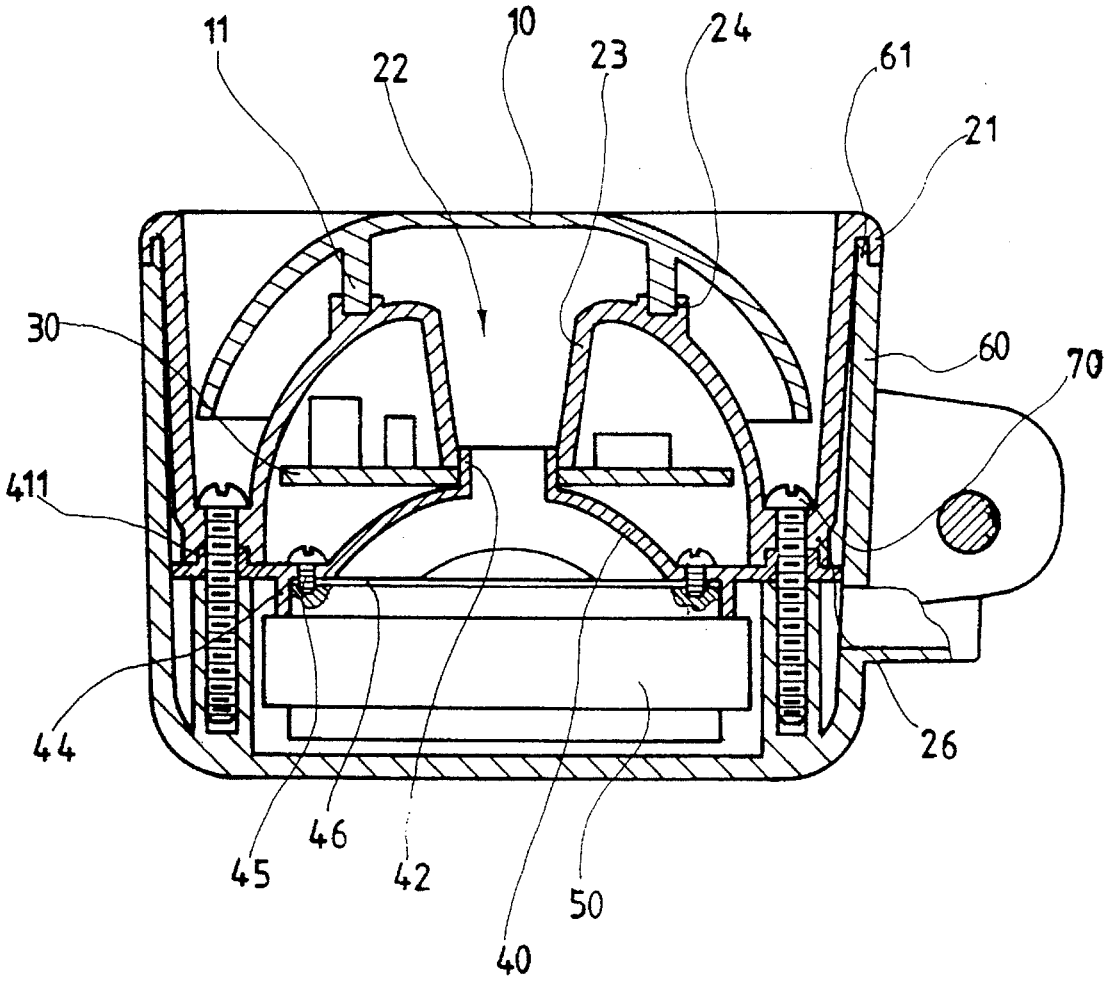
FIG. 2 is a sectional view of the assembled structure of the present invention.
Figure 3:
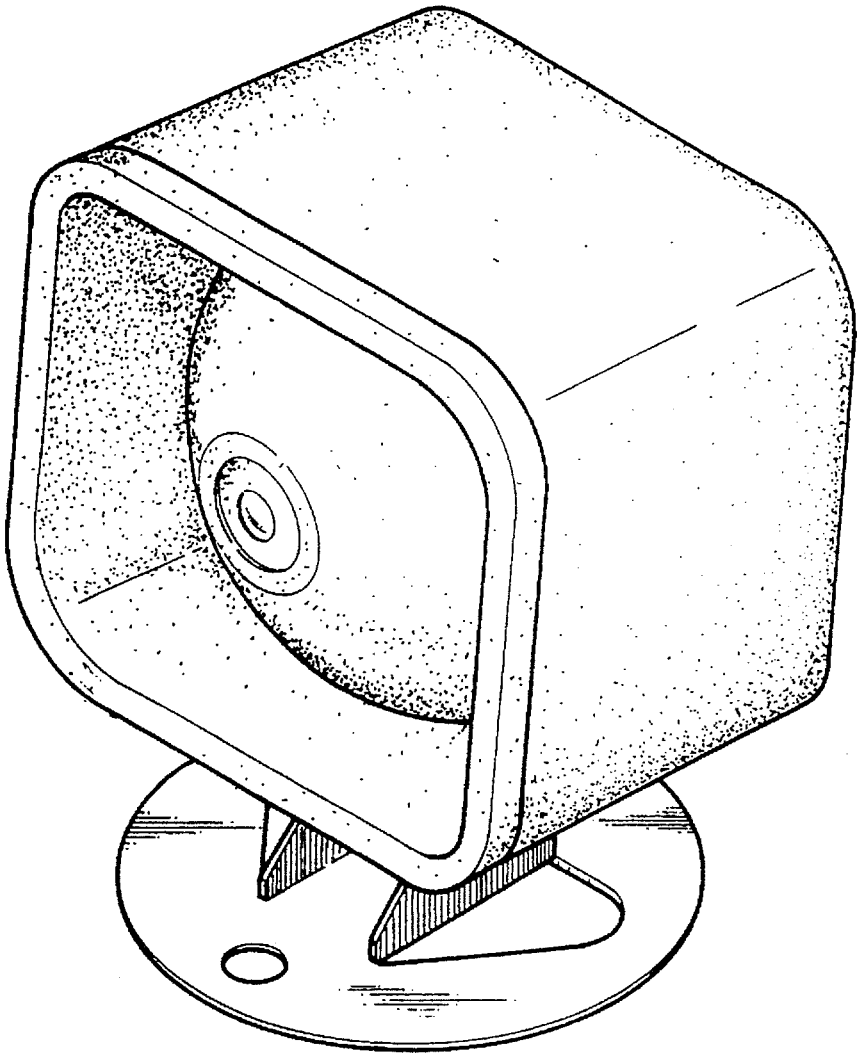
FIG. 3 is a perspective view of the appearance of the present invention.
Figure 4:
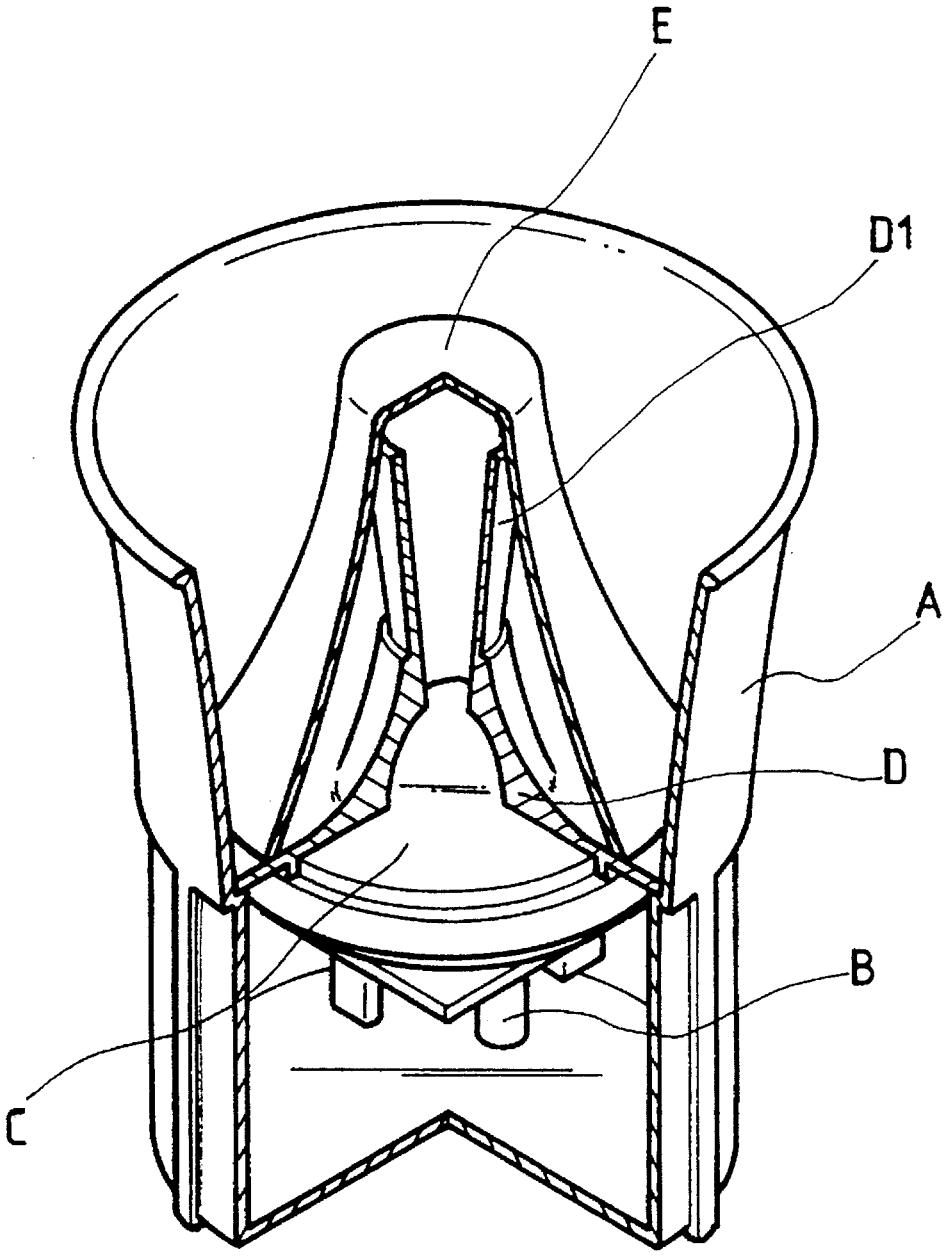
FIG. 4 is a perspective exploded view of a conventional structure.

With the above mentioned members, and referring to FIG. 2, the screws 45 lock the sound-film 46 and the magnet 50 within the encircling plate 44 of the supporting plate 40 to form an integrated unit, then the sound emitting circuit board 30 is placed on the acoustic pipe 42 of the supporting plate 40 to allow the acoustic pipe 42 to protrude through it, and the positioning sleeves 26 of the sound transmitting case 20 are fit over the locating columns 411, the same is the case of the acoustic pipe column 23 over the acoustic pipe 42, the assembled members are placed in the main case body 60 to render the inserting plate portion 61 on the upper periphery thereof to insert in the down bending edge 21 of the sound transmitting case 20, then four bolts 70 are screwed into the through holes 25 provided at the four corners on the bottom of the sound transmitting case 20 to lock the supporting plate 40 having the sound emitting circuit board 30 in the main case body 60, and insert the four fixing rods 11 of the acoustic resonant lid 10 into the four fixing holes 24 provided on the spherical dome surface of the sound transmitting case 20 to complete assembling, with this assembly, the magnet type sounder of the electronic acoustic alarm can achieve the object of physical volume reducing without influencing resonance and volume of sound thereof. Meantime, in view that the sound emitting circuit board 30 is placed in the space between the supporting plate 40 and the spherical dome surface of the sound transmitting case 20, heat sinking effect therein can be better than that of the conventional magnet type sounder, this can protect the functionality of the electronic loop of the sound emitting circuit board 30. As shown in FIG. 3 which is a perspective view of the appearance of the present invention, when it is compared with the conventional alarm shown in FIG. 4, we can see that physical volume of the present invention is much smaller.

It will be apparent to those skilled in this art that various modifications or changes can be made to the exemplar embodiment of the present device without departing from the spirit and scope of this invention. Accordingly, all such modifications and changes also fall within the scope of the appended claims and are intended to form part of this invention.

Having thus described the technical structure of my invention with practicability and improveness, the structure has never existed in the markets, therefore, what I claim as new and desire to be secured by Letters Patent of the United States is:

1. An improved structure of magnet type sounder of electronic acoustic alarms, comprising:

an acoustic resonant lid in the form of a dome with four fixing rods provided there on;

a sound transmitting case having a down bending edge provided on the periphery thereof and having a spherical dome surface protruded at the center thereof, a through hole extending down to form a flared acoustic pipe column being provided at the center of said spherical dome surface, and four fixing holes being provided on said spherical dome surface for fixing said acoustic resonant lid, a positioning sleeve each with a through hole being provided at each of the four corners on the bottom of said sound transmitting case;

a supporting plate in the form of a round plate, at the locations on said round plate corresponding to those positions of said positioning sleeves of said sound transmitting case there being provided with a plurality of protruding plates each having a locating column, said supporting plate having at the center thereof another spherical dome surface which has an acoustic pipe three screw holes being provided on the periphery of said another spherical dome surface, an encircling plate being provided beneath said supporting plate to hold therein a sound-film and a magnet, then a plurality of screws being screwed down in said screw holes on said supporting plate for receiving said sound-film and said magnet beneath said supporting plate;

a main case body having an inserting plate portion for inserting in said down bending edge of said sound transmitting case, four fixing columns being provided at the four corners of said main case body;

said sound emitting circuit board is placed on the acoustic pipe on said another spherical dome surface of said supporting plate, while said sound-film and said magnet are received beneath said supporting plate, the assembled members are placed in said main case body, and said sound transmitting case having said flared acoustic pipe column is placed thereon to render said acoustic pipe column to fit over said acoustic pipe, said acoustic resonant lid then is placed on said acoustic pipe column, as result, the object of volume reducing can be achieved.

* * * * *